United States Patent [19]

Grube et al.

[11] Patent Number: 4,671,300

[45] **Date of Patent: * Jun. 9, 1987**

[54] SMOKELESS ASHTRAY

[75] Inventors: Clifford E. Grube, Niles; William Kalnins, Maple Park, both of Ill.

[73] Assignee: Associated Mills, Inc., Chicago, Ill.

[ * ] Notice: The portion of the term of this patent subsequent to Apr. 8, 2003 has been disclaimed.

[21] Appl. No.: 570,460

[22] Filed: Jan. 13, 1984

[51] Int. Cl.[4] ..... A24F 19/00

[52] U.S. Cl. ..... 131/231; 55/385 G

[58] Field of Search ..... 131/231, 235.1, 240.1, 131/242, 256, 257; 55/385 G, 467, 413

[56] References Cited

U.S. PATENT DOCUMENTS

| | | | |
|---|---|---|---|
| 2,788,085 | 4/1957 | Waller | 131/231 |
| 3,685,258 | 8/1972 | Kostel et al. | 55/467 |
| 3,958,965 | 5/1976 | Raczkowski | 55/385 G |
| 4,119,419 | 10/1978 | Passaro et al. | 55/385 G |
| 4,148,618 | 4/1978 | Christenson et al. | 131/231 |
| 4,154,251 | 5/1979 | Doyel | 131/231 |
| 4,161,181 | 7/1979 | Nicks et al. | 131/231 |

OTHER PUBLICATIONS

Ronco Smokeless Ashtray; by Ronco, Inc., 1200 Arthur Avenue, Elk Grove Village, Illinois 60007.

Ronco Automobile Smokeless Ashtray; by Ronco, Inc., 1200 Arthur Avenue, Elk Grove Village, Illinois 60007.

*Primary Examiner*—Richard J. Apley

*Assistant Examiner*—H. Macey

*Attorney, Agent, or Firm*—Allegretti, Newitt, Witcoff & McAndrews, Ltd.

[57] ABSTRACT

An ashtray for eliminating emitted smoke is disclosed. The ashtray defines, within its housing, a predetermined, fixed filter region. An air filter is positioned within and confined by the filter region to ensure that substantially all air passes through the filter medium of the air filter.

6 Claims, 5 Drawing Figures

SMOKELESS ASHTRAY

BACKGROUND OF THE INVENTION

The present invention relates generally to an ashtray and more particularly to an ashtray wherein cigar and cigarette smoke is drawn through the ashtray housing and substantially eliminated by a filter material.

Numerous battery-driven "smokeless" ashtrays are presently available. The major shortcoming thereof resides in an inability to draw the emitted smoke into the ashtray housing and through the filtering element. The problem is, in actuality, twofold.

The first aspect concerns the "drawing" power of the ashtray. Often the ambient air conditions interfere with the drawing action, such that smoke is seen rising above the ashtray prior to dispersion.

The second aspect relates more directly to the filtering of the air as it passes through the ashtray housing. In many "smokeless" ashtrays, a substantial portion of the airflow bypasses the filtering medium or element, such that the air exhausted from the ashtray contains visible smoke particles.

Another significant shortcoming encountered with the presently available "smokeless" ashtray is noise. Two factors are significant, i.e., motor vibration and whistling.

SUMMARY OF THE INVENTION

In a principal aspect, the present invention is an improved battery-powered "smokeless" ashtray. The improvement focuses upon a structure, configuration and arrangement which provides an acceptable air-drawing capability, a defined airflow passage to ensure substantially complete filtering, and an acceptable noise level.

More particularly, the present invention is a "smokeless" ashtray having a substantially cylindrical housing. The housing includes upper and lower housing members adapted to interconnectingly mate or engage. The upper and lower housing members cooperatively define a predetermined airflow passage therethrough and a predetermined, confined filter region intercepting the airflow passage.

The upper housing member has a smoking material retention ring, which encompasses a depressed ash collection cavity. The retention ring is adapted to hold smoking materials, e.g., cigars and cigarettes. The ash collection cavity communicates with the airflow passage through a series of smoke passageways.

The lower housing member includes a series of air-release passageways. The air-release passageways likewise communicates with the airflow passage through the housing.

A battery-powered fan assembly develops an airflow (including smoke and other impurities), originating in the proximity of the retention ring and ash collection cavity, entering the housing through the smoke passageways, passing through the airflow passage and filter region, and ultimately existing the air-release passageways in the lower housing member. An air filter is confined within and substantially fills the predetermined filter region to remove the smoke and impurities from the air flow. The air filter includes a rigid housing adapted to hold the filter medium in a configuration closing matching the confines of the filter region. The rigidity and confinement of the air filter substantially avoids any bypassing of the filter medium.

It is thus an object of the present invention to provide an improved "smokeless" ashtray. Another object is a battery-powered "smokeless" ashtray which includes and defines a predetermined, relatively fixed airflow passage therethrough.

Still another object is an improved battery-driven, filtering ashtray wherein a substantially rigid air filter is positioned within and confined to a predetermined filter region, so as to intercept the airflow passage. It is a further object of the present invention to provide a readily manufactured, readily maintained "smokeless" ashtray.

These and other objects, features and advantages of the present invention are set forth or implicit in the following description of a preferred embodiment.

BRIEF DESCRIPTION OF THE DRAWING

A preferred embodiment of the present invention is described, in detail, with reference to the drawing wherein.

DETAILED DESCRIPTION OF A PREFERRED EMBODIMENT

The present invention is shown in FIGS. 1–5 as a smokeless ashtray, generally designated 10. The ashtray 10 generates a filtered airflow or airstream, eliminating smoke emitted in the immediate area of the ashtray 10.

Figure 3:
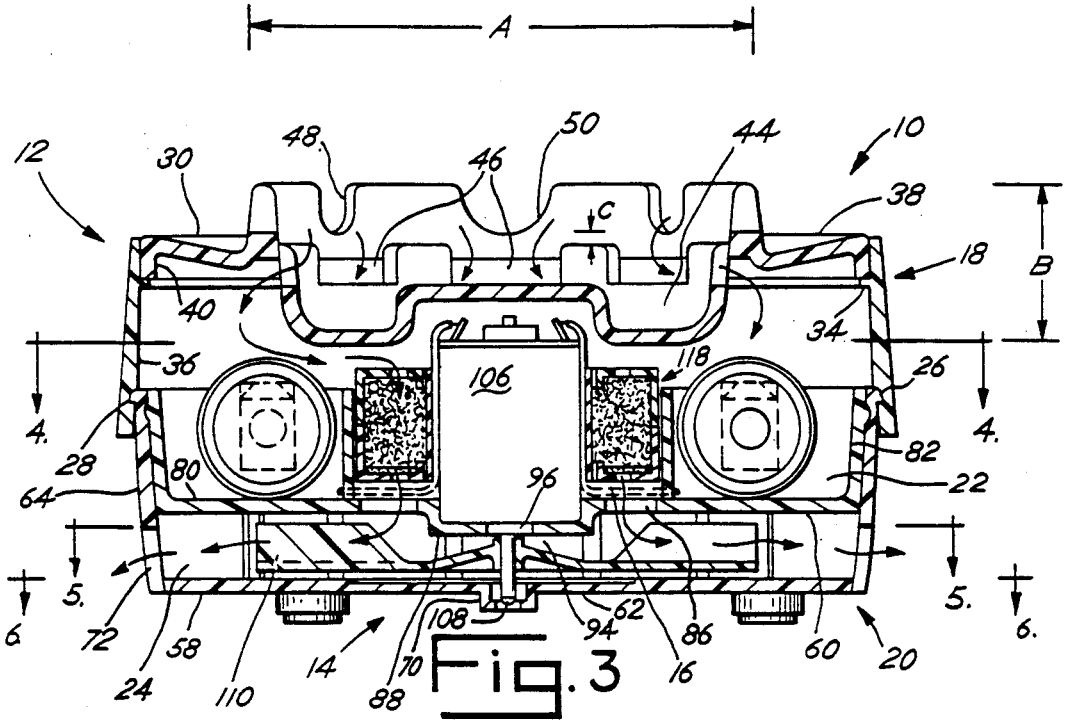
FIG. 3 is a cross-sectional view of the preferred embodiment shown in FIG. 1 taken along 3—3.

More particularly, the ashtray 10 includes, as its major components, a housing 12, a battery-driven fan mechanism 14, and an air filter 16. The housing 12 is substantially cylindrical and includes upper and lower housing members 18, 20. The upper and lower housing members 18, 20 interlockingly mate to define upper and lower housing chambers 22, 24 therein. The upper and lower housing members 18, 20 are preferably plastic to facilitate production, and as best shown in FIG. 3, the two housing members 18, 20 interlock by means of a lip 26 and groove 28. Separation is obtained by flexing the upper housing member 18 and disengaging the lip 26 from the groove 28.

Figure 1:
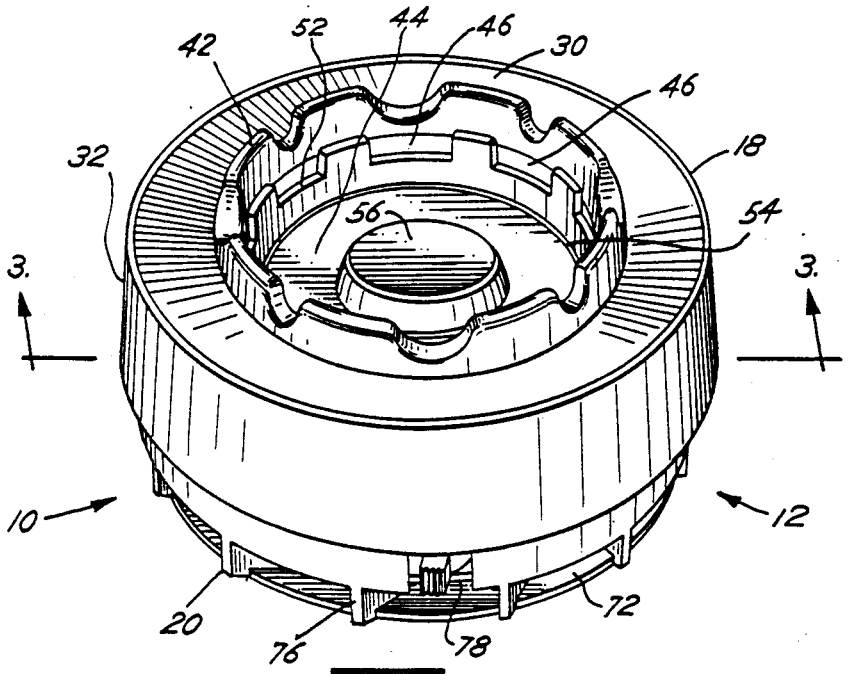
FIG. 1 is a perspective view of a preferred embodiment.
Figure 2:
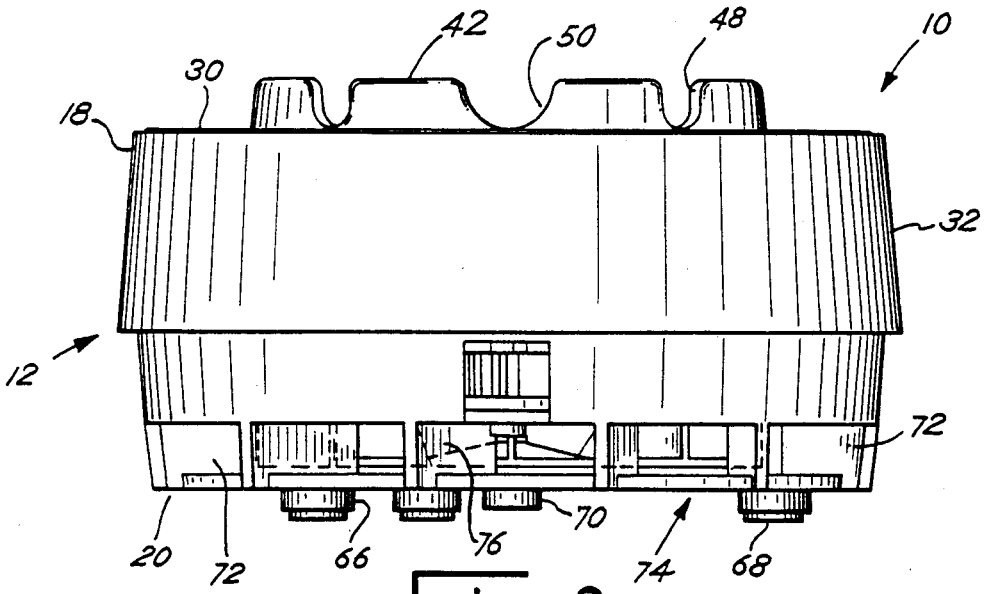
FIG. 2 is a side view of the preferred embodiment shown in FIG. 1.

Referring now to FIGS. 1–3, the upper housing member 18 is preferably two-pieced to facilitate manufacture and assembly, including a top section 30 and a substantially-cylindrical support section 32. The support section 32 defines the groove 28 and further includes a support ledge or flange 34 extending about the inner periphery 36. The top section 30 rests upon the support ledge 34 in the assembled state.

The top section 30 of the upper housing member 18 includes a substantially annular edge portion 38 having a downwardly extending lip 40. The edge portion 38 substantially matches the inner periphery 36 of the support section 32, such that the lip 40 engages the support ledge 34.

The top section 30 further includes a smoking material retention ring 42, an ash collection cavity 44, and a series of smoke passageways 46. As shown, the retention ring 42 encompasses the ash collection cavity 44, extending substantially upright from the annular edge portion 38. The retention ring 30 includes two alternating series of notches 48, 50, adapted to receive and hold cigars and cigarettes, respectively. The ash collection cavity 44 is a depression within the retention ring 30, extending below the annular edge portion 38.

The ash collection cavity 44 is substantially cylindrical, defined by a cavity sidewall 52 and an ash drop plate 54 at the lower extreme thereof. The ash collection cavity 44 is further defined by a smoking material support stand 56, centrally located and slightly elevated with respect to the ash drop plate 54.

The smoke passageways 46 extend through the cavity sidewall 52 of the ash collection cavity 44, equally spaced thereabout, to provide communication between the ash collection cavity 44 and the upper housing chamber 22. Preferably the smoke passageways 46 are substantially rectangular openings, providing minimal resistance to airflow therethrough.

The "working area" of the ashtray 10 is defined by the retention ring 42 and ash collection cavity 44 and includes diameter "A" and depth "B" dimensions, as shown in FIG. 3. Preferably the ratio A/B is between three (3) and four (4) to substantially reduce and minimize the adverse effect of ambient air conditions upon the operation of the ashtray 10. If the depth of the smoke passageways 46 or the distance from the center of the ash collection cavity 44 to the smoke passageways 46 is too great, then the airflow or "draw" of the ashtray 10 is subject to disruption by room air currents. The distance, c, between the upper side of the smoke passageways 46 and the lower extreme of the notches 48, 50 is also a significant parameter in terms of effectiveness. This distance should not exceed one-quarter inch (¼"), and a preferred dimension is three-sixteenths (3/16) of an inch.

The lower housing member 20 is also preferably two-pieced for ease of manufacture and assembly, having a base section 58 adapted to receive an insert section 60. As best shown in FIG. 3, the insert section 60 provides the division between the upper and lower housing chambers 22, 24.

The base section 58 includes a base plate 62 and substantially cylinderical, upwardly extending base sidewall 64. The base plate 62 also includes tripod-arranged legs 66, having pads 68. The pads 68 reduce operating noise and substantially avoid marring and scratching of the underlying surface. The base plate 62 has a centrally-located motor mount 70.

The base section 58 defines a series of air-release passageways 72 in the base sidewall 64. The air-release passageways 72 are generally rectangular in cross section. The passageways 72 are, however, defined and separated by a radial vane arrangement, generally designated 74, which includes a series of equally-spaced planar vanes 76. The vanes 76 are preferably oriented at thirty degree (30°) angle with respect to a radius (not shown) extending from the center of the base section 58 (i.e., the motor mount 70) to the outermost edge of the vane 76 in question. The vanes 76 extend inwardly a predetermined distance, terminating in a tapered end. The base sidewall 64 further defines a switch access opening 78 adjacent and immediately above one of the air-release passageways 72.

The insert section 60 includes a dividing plate 80 and an upwardly extending insert sidewall 82. The dividing plate 80 rests upon the vanes 76 and the insert sidewall 82 matches and substantially engages the uppermost portion of the base sidewall 64 in the assembled state. The insert sidewall 82 also defines a switch opening 84, and the switch openings 78, 84 align in the assembled state.

The insert section 60 further includes a centrally-located, generally annular opening 86 so as to define a centrally-located motor support platform 88. The motor support platform 88 is connected to the dividing plate 80 by two pairs of ribs 90, 92, dividing the opening 86 into four quadrants. The motor support platform 88 defines a central, substantially-cylindrical recess 94 and a rotor passage 96 extending therethrough. In the assembled state, the motor mount 70 and the rotor passage 96 substantially align. As shown in FIG. 3, the ribs 90 are channeled.

The insert section 60 also includes a series of interior, substantially upright walls, generally designated 98. The interior walls 98 define a centrally-located, substantially rectangular filter area 100 and two battery storage areas 102, 104, interposed the filter region 100 and the insert sidewall 82.

Figure 4:
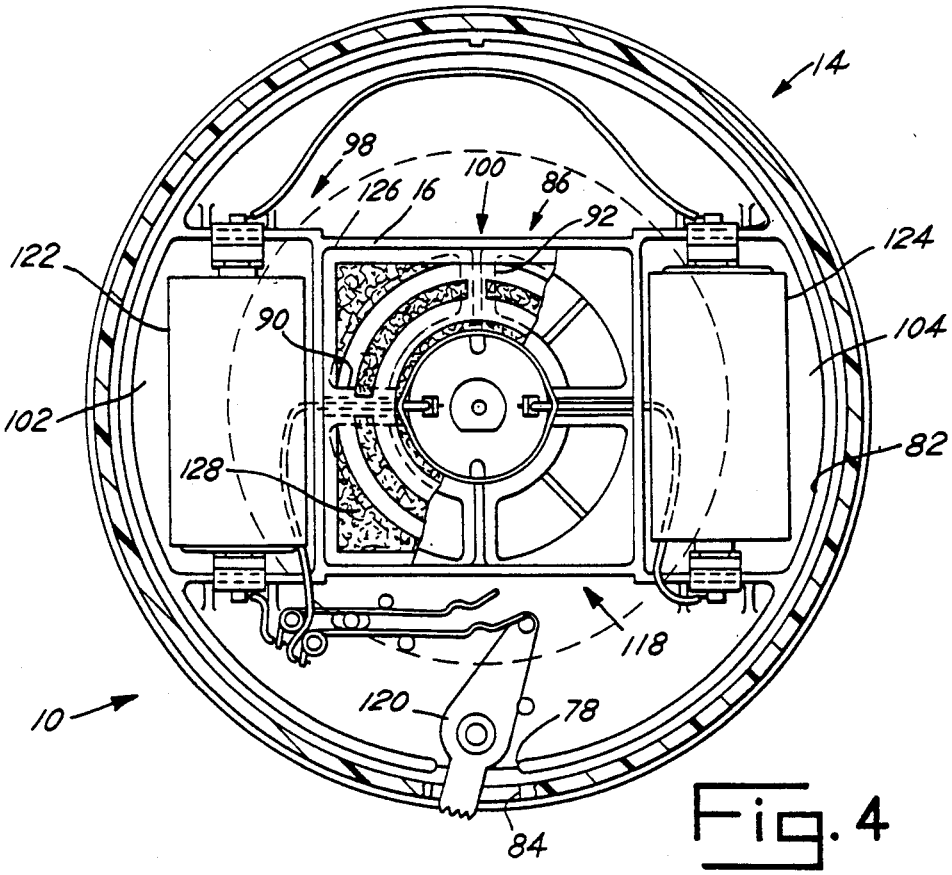
FIG. 4 is a cross-sectional view taken from FIG. 3 along 4—4.
Figure 5:
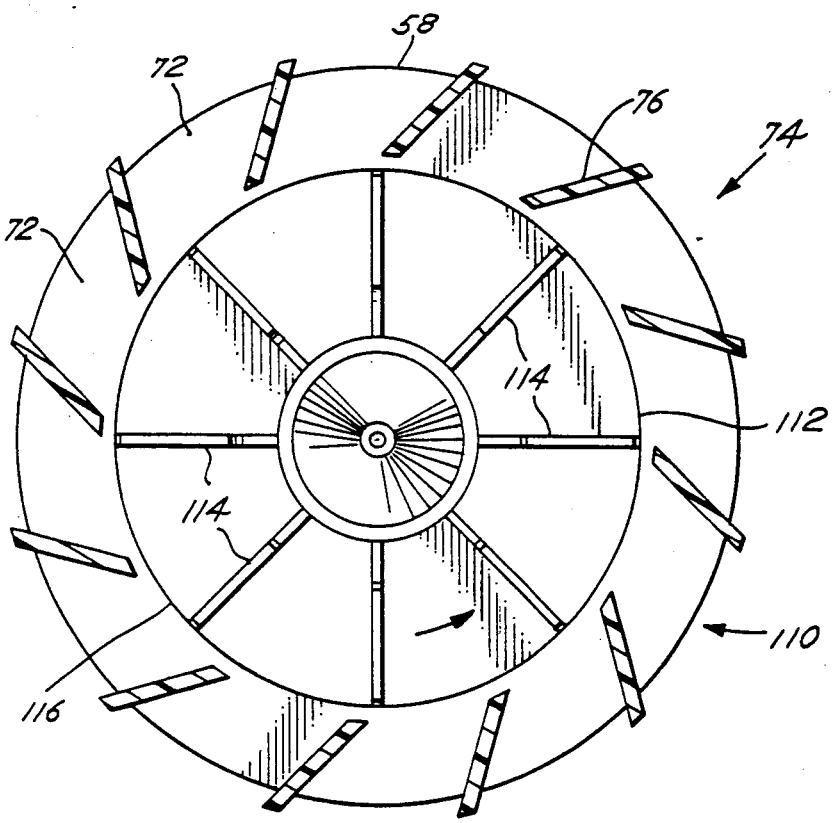
FIG. 5 is a cross-sectional view taken from FIG. 3 along 5—5.

As best shown in FIGS. 3 and 4, the battery-driven fan mechanism 14 includes a battery-driven motor 106 having a rotor 108. The motor 106 is received by and secured within the recess 94 of the motor support platform 88, such that the rotor 108 extends through the rotor passage 96. A fan assembly 110 is secured to the rotor 108 below the dividing plate 80 of the insert section 60. As shown in FIG. 5, the fan assembly 110 includes a fan disc 112, which is substantially parallel to the base plate 62, and a series of blades 114. The blades 114 are secured to the fan disc 112 and extend radially inwardly from the periphery 116 of the fan disc 112.

As best shown in FIGS. 3 and 5, the configuration of the vanes 76 accomodates the fan assembly 110, such that the vanes 76 and blades 114 are at approximately the same elevation in the assembled state. Preferably, the operational direction of the motor 106 and fan assembly 110 is "against" of the vanes 76 (as shown by the arrow in FIG. 5). This airflow pattern substantially avoids whistling and other forms of air movement noise.

The motor 106 is also fixed at the lower extreme by engagement of the motor mount 70 and rotor 108. Securement of the motor 106 in this manner substantially reduces motor vibration and resultant noise.

In the assembled state, the housing 12 (more particularly the insert section 60) and the fan mechanism 14 (more particularly the motor 106) cooperate to define a predetermined, confined filter region 118. This filter region 118 has a substantially square outer periphery and a substantially cylindrical inner periphery, corresponding to the annular opening 86 in the insert section 60.

The fan mechanism 14 also includes an ON-OFF switch 120 and a pair of batteries 122, 124 held within the battery storage regions 102, 104, which are electrically interconnected with the motor 106 in a conventional manner. The leads to the motor 106 are positioned in the channeled ribs 90 to avoid interference. As shown in FIG. 4, the switch 120 extends through the switch openings 78, 84 in the assembled state.

The air filter 16 includes a rigid housing 126 and a filter medium 128. As best shown in FIG. 4, the rigid housing 126 is substantially rectangular and conforms closely to the confines (i.e., outer periphery) of the filter region 118.

The filter medium 128 substantially fills the rigid housing 126 and defines a substantially cylindrical central opening to closely accommodate the motor 106 in the assembled state. As such, vitually all air passing through the filter region 118 contacts the filter medium 128. This configuration substantially avoids any significant bypassing of the air filter 16 during operation of the ashtray 10.

Preferably the filter medium 128 is a multistage filter including activated charcoal. One particularly preferred filter medium 128 is fully described in a copending patent application, Ser. No. 392,752, filed June 28, 1982 in the names of Hilger and Kalnins. The teachings thereof are fully incorporated herein by reference.

In terms of operation, the ashtray 10 defines and provides a relatively fixed and predetermined airflow passage (shown by the arrows in FIG. 3) through the housing 12. Substantially all air drawn into the upper housing chamber 22 by operation of the fan mechanism 14 passes through the filter region 118 prior to exiting through the air-release passageways 72. As shown, the upper housing chamber 22 communicates with the lower housing chamber 24 substantially solely through the predetermined and confined filter region 118, due to the interlocking of housing members 18, 20 and the close fit between the base section 58 and insert section 60. Since the substantially rigid air filter 16 fills the filter region 118 in a controlled manner, virtually all drawn air is filtered to substantially remove smoke particles and other impurities.

A single preferred embodiment of the present invention has been described herein. It is to be understood, however, that various modifications and changes can be made without departing from the scope and spirit of the present invention, as defined by the following claims.

What is claimed is:

1. An ashtray comprising, in combination:

a substantially cylindrical housing including an upper housing member and a lower housing member adapted to interlockingly mate so as to define an upper housing chamber, a lower housing chamber, a predetermined airflow passage through said housing, and a predetermined airflow passage through said housing, and a predetermined, confined filter region intercepting said airflow passage;

said upper housing member having a smoking material retention ring, an ash collection cavity extending within and below said smoking material retention ring, and a series of smoke passageways in the sidewalls of said ash collection cavity providing communication between said ash collection cavity and said predetermined airflow passage within said housing, the bottom of said ash collection cavity being imperforate;

said smoking material retention ring and said ash collecting cavity defining a working area having a diameter A and depth B, the ratio of A to B being in the range of between three and four to substantially reduce and minimize the adverse effect of ambient air conditions, said lower housing member having a series of air-release passageways, said airflow passage extending from said smoke passageways to said air-release passageways;

battery-driven fan means for developing an airflow from the proximity of said smoking material retention ring and said ash collection cavity through said airflow passage, said battery-driven fan means including a motor within said substantially cylindrical housing and a fan assembly operative substantially within said lower housing member;

an annular air filter disposed in said airflow passage and adapted to remove smoke and impurities from said airflow, said air filter including a rigid housing and a filter medium, said air filter defining a central opening for closely accommodating said motor of said battery-drive fan means, said air filter substantially filling and closely conforming to said filter region to substantially avoid bypassing of said filter medium by said airflow.

2. An ashtray as claimed in claim 1 wherein said air-release passageways are further defined by a series of vanes having a predetermined orientation with respect to said airflow and said motor, said fan assembly and said vanes being at approximately the same elevation in said lower housing member.

3. An ashtray as claimed in claim 2 wherein said vanes are radially oriented at a predetermined angle, said motor operating to move said airflow against said vanes, whereby air movement noises are substantially avoided.

4. An ashtray as in claim 3 wherein said predetermined angle is 30 degrees.

5. An ashtray as claimed in claim 1 wherein said motor includes a rotor, said lower housing member includes a motor mount, said rotor engaging said motor mount to substantially avoid vibration of said motor during operation of said ashtray.

6. An ashtray as claimed in claim 1 wherein said substantially cylindrical housing and said motor cooperatively define said filter region.

* * * * *